US008282188B2

(12) United States Patent
Maida

(10) Patent No.: US 8,282,188 B2
(45) Date of Patent: Oct. 9, 2012

(54) INKJET HEAD CLEANING APPARATUS, IMAGE RECORDING APPARATUS AND INKJET HEAD CLEANING METHOD

(75) Inventor: Noriaki Maida, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 291 days.

(21) Appl. No.: 12/750,113

(22) Filed: Mar. 30, 2010

(65) Prior Publication Data

US 2010/0245464 A1 Sep. 30, 2010

(30) Foreign Application Priority Data

Mar. 31, 2009 (JP) ..... 2009-087491

(51) Int. Cl.
*B41J 2/165* (2006.01)

(52) U.S. Cl. ..... 347/29; 347/34; 347/35; 347/28; 347/32; 347/33

(58) Field of Classification Search ..... 347/28, 347/29, 32–35
See application file for complete search history.

(56) References Cited

U.S. PATENT DOCUMENTS 6,281,909 B1 8/2001 Fassler et al.
6,592,201 B2 7/2003 Sharma et al.

FOREIGN PATENT DOCUMENTS

JP 2000-94703 A 4/2000

*Primary Examiner* — Matthew Luu
*Assistant Examiner* — Henok Legesse
(74) *Attorney, Agent, or Firm* — Birch, Stewart, Kolasch & Birch, LLP

(57) ABSTRACT

The inkjet head cleaning apparatus includes: a cleaning liquid holding device having a cleaning liquid holding surface with which cleaning liquid is held and applied to a liquid ejection surface of an inkjet head in which the liquid ejection surface is oblique to a horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

12 Claims, 11 Drawing Sheets

INKJET HEAD CLEANING APPARATUS, IMAGE RECORDING APPARATUS AND INKJET HEAD CLEANING METHOD

BACKGROUND OF THE INVENTION

1. Field of the Invention

The present invention relates to an inkjet head cleaning apparatus, an image recording apparatus and an inkjet head cleaning method, and more particularly to technology for cleaning a liquid ejection surface of an inkjet head.

2. Description of the Related Art

As a general image recording apparatus, it is suitable to use an inkjet recording apparatus, which forms a desired image on a recording medium by ejecting and depositing colored inks from a plurality of nozzles provided in an inkjet head. If the inkjet head is operated for a long period of time, adhering matter such as solidified ink or paper dust from the recording medium, and the like, adhere to the nozzle surface. In particular, if adhering matter becomes attached to the vicinity of the nozzles and the nozzle apertures, this gives rise to deflection of the ejection direction of the ink ejected from the nozzles, or reduction in the ejection volume, and so on. An inkjet recording apparatus is composed in such a manner that cleaning of the nozzle surface is carried out appropriately.

Japanese Patent Application Publication No. 2000-094703 discloses a cleaning apparatus which applies a cleaning liquid in a non-contact fashion to an inkjet head, by rotating an application roller having a cylindrical shape which is immersed in the cleaning liquid.

An inkjet recording apparatus which employs a drum conveyance method whereby a recording medium is held on the outer circumferential surface of a round cylindrical conveyance drum and conveyed on the outer circumferential surface of the conveyance drum, as a device for conveying the recording medium, is disposed obliquely to the horizontal plane in such a manner that the recording head faces the outer circumferential surface of the conveyance drum.

A cleaning apparatus 260 shown in FIG. 11 has a cleaning liquid application unit 262 which holds a cleaning liquid 261 on a surface 262A facing the nozzle surface 272A of the inkjet head (head) 272, and employs a method which brings the cleaning liquid 261 into contact with the nozzle surface 272A to apply cleaning liquid to the nozzle surface 272A. FIG. 11 is a diagram of a full line type head 272 viewed from the breadthways direction thereof, and the direction passing through the plane of the drawing is the lengthwise direction of the head 272.

When the nozzle surface 272A of the head 272 that is arranged obliquely to the horizontal plane is cleaned by using the above-described cleaning apparatus 260, then the cleaning liquid 261 collects on the inclined lower side 262C rather than being held on the inclined upper side 262B, and it is difficult to apply the cleaning liquid uniformly to the nozzle surface 272A. For example, if a composition is adopted in which a device (e.g., a nozzle) for emitting cleaning liquid is arranged on a surface facing the nozzle surface 272A and the cleaning liquid is emitted in the form of a shower by using a high pressure, then it is possible to form a coating layer of the cleaning liquid over the whole of the surface on which the cleaning liquid is emitted. However, this system is not desirable since it needs supplying the cleaning liquid of over the necessary amount.

The cleaning apparatus described in Japanese Patent Application Publication No. 2000-094703 consumes a large quantity of the cleaning liquid in order to provide the application roller with a coating layer of a certain thickness of the cleaning liquid.

SUMMARY OF THE INVENTION

The present invention has been contrived in view of these circumstances, an object thereof being to provide an inkjet head cleaning apparatus, an image recording apparatus and an inkjet head cleaning method, whereby cleaning processing using a small quantity of cleaning liquid is possible.

In order to attain the aforementioned object, the present invention is directed to an inkjet head cleaning apparatus, comprising: a cleaning liquid holding device having a cleaning liquid holding surface with which cleaning liquid is held and applied to a liquid ejection surface of an inkjet head in which the liquid ejection surface is oblique to a horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

According to the present invention, since the cleaning liquid is deposited onto the liquid ejection surface by supplying the cleaning liquid from the upper portion of the inclined cleaning liquid holding surface, which is disposed in the position facing the liquid ejection surface of the inkjet head oblique to the horizontal plane and which is inclined substantially in parallel with the liquid ejection surface with respect to the horizontal plane, whereby the cleaning liquid slides down the inclined cleaning liquid holding surface while wetting the liquid ejection surface and the cleaning liquid holding surface and spreading between the surfaces, then it is possible to apply the cleaning liquid over the whole of the liquid ejection surface of the inkjet head by using a small quantity of cleaning liquid compared to a method in which the cleaning liquid is sprayed from an entire surface facing the liquid ejection surface of the inkjet head, and therefore the amount of cleaning liquid supplied between the liquid ejection surface and the cleaning liquid holding surface can be greatly reduced.

DETAILED DESCRIPTION OF THE PREFERRED EMBODIMENTS

Entire Configuration of Inkjet Recording Apparatus

First, an inkjet recording apparatus will be described as an embodiment of an image recording apparatus according to the present invention.

Figure 1:
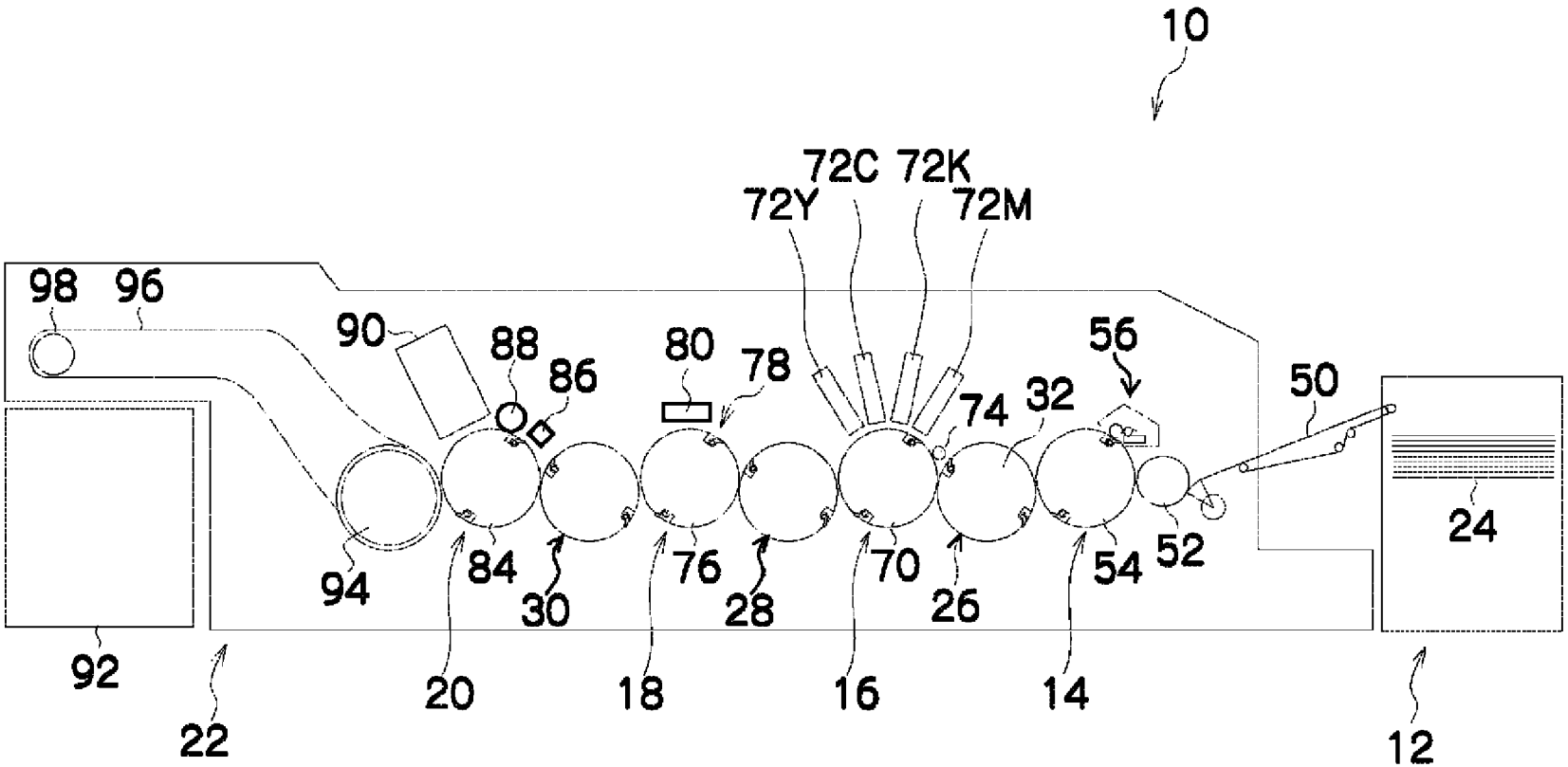
FIG. 1 is a general schematic drawing of an inkjet image recording apparatus according to an embodiment of the present invention.

FIG. 1 is a structural diagram illustrating the entire configuration of an inkjet recording apparatus 10 according to an embodiment of the present invention. The inkjet recording apparatus 10 shown in the drawing is an recording apparatus in a two-liquid aggregating system of forming an image on a recording surface of a recording medium 24 by using ink (an aqueous ink) and a treatment liquid (aggregation treatment liquid). The inkjet recording apparatus 10 includes a paper feed unit 12, a treatment liquid application unit 14, an image formation unit 16, a drying unit 18, a fixing unit 20, and a discharge unit 22 as the main components. A recording medium 24 (paper sheets) is stacked in the paper feed unit 12, and the recording medium 24 is fed from the paper feed unit 12 to the treatment liquid application unit 14. A treatment liquid is applied to the recording surface in the treatment liquid application unit 14, and then a color ink is applied to the recording surface in the image formation unit 16. The image is fixed with the fixing unit 20 on the recording medium 24 onto which the ink has been applied, and then the recording medium is discharged with the discharge unit 22.

In the inkjet recording apparatus 10, intermediate conveyance units 26, 28 and 30 are provided between the units, and the recording medium 24 is transferred by these intermediate conveyance units 26, 28 and 30. Thus, a first intermediate conveyance unit 26 is provided between the treatment liquid application unit 14 and image formation unit 16, and the recording medium 24 is transferred from the treatment liquid application unit 14 to the image formation unit 16 by the first intermediate conveyance unit 26. Likewise, the second intermediate conveyance unit 28 is provided between the image formation unit 16 and the drying unit 18, and the recording medium 24 is transferred from the image formation unit 16 to the drying unit 18 by the second intermediate conveyance unit 28. Further, a third intermediate conveyance unit 30 is provided between the drying unit 18 and the fixing unit 20, and the recording medium 24 is transferred from the drying unit 18 to the fixing unit 20 by the third intermediate conveyance unit 30.

Each unit (paper feed unit 12, treatment liquid application unit 14, image formation unit 16, drying unit 18, fixing unit 20, discharge unit 22, and first to third intermediate conveyance units 26, 28 and 30) of the inkjet recording apparatus 10 will be described below in greater details.

<Paper Feed Unit>

The paper feed unit 12 feeds the recording medium 24 to the image formation unit 16. A paper feed tray 50 is provided in the paper feed unit 12, and the recording medium 24 is fed, sheet by sheet, from the paper feed tray 50 to the treatment liquid application unit 14.

<Treatment Liquid Application Unit>

The treatment liquid application unit 14 is a mechanism that applies a treatment liquid to the recording surface of the recording medium 24. The treatment liquid includes a coloring material aggregating agent that causes the aggregation of a coloring material (pigment) included in the ink applied in the image formation unit 16, and the separation of the coloring material and a solvent in the ink is enhanced when the treatment liquid is brought into contact with the ink.

As shown in FIG. 1, the treatment liquid application unit 14 includes a paper transfer drum 52, a treatment liquid drum 54, and a treatment liquid application device 56. The paper transfer drum 52 is disposed between the paper feed tray 50 of the paper feed unit 12 and the treatment liquid drum 54. The rotation of the paper transfer drum 52 is driven and controlled by a below-described motor driver 176 (see FIG. 9). The recording medium 24 fed from the paper feed unit 12 is received by the paper transfer drum 52 and transferred to the treatment liquid drum 54. The below-described intermediate conveyance unit may be also provided instead of the paper transfer drum 52.

The treatment liquid drum 54 is a drum that holds and rotationally conveys the recording medium 24. The rotation of the treatment liquid drum 54 is driven and controlled by the below-described motor driver 176 (see FIG. 9). Further, the treatment liquid drum 54 is provided on the outer circumferential surface thereof with a hook-shaped holding device, by which the leading end of the recording medium 24 can be held. In a state in which the leading end of the recording medium 24 is held by the holding device, the treatment liquid drum 54 is rotated to rotationally convey the recording medium 24. In this case, the recording medium 24 is conveyed in a state where the recording surface thereof faces outward. The treatment liquid drum 54 may be provided with suction apertures on the outer circumferential surface thereof and connected to a suction device that performs suction from the suction apertures. As a result, the recording medium 24 can be held in a state of tight adherence to the outer circumferential surface of the treatment liquid drum 54.

The treatment liquid application device 56 is provided on the outside of the treatment liquid drum 54 opposite the outer circumferential surface thereof. The treatment liquid application device 56 applies the treatment liquid onto the recording surface of the recording medium 24. The treatment liquid application device 56 includes: a treatment liquid container, in which the treatment liquid to be applied is held; an anilox roller, a part of which is immersed in the treatment liquid held in the treatment liquid container; and a rubber roller, which is pressed against the anilox roller and the recording medium 24 that is held by the treatment liquid drum 54, so as to transfer the treatment liquid metered by the anilox roller 64 to the recording medium 24.

With the treatment liquid application device 56 of the above-described configuration, the treatment liquid is applied onto the recording medium 24, while being metered. In this case, it is preferred that the film thickness of the treatment liquid be sufficiently smaller than the diameter of ink droplets that are ejected from inkjet heads 72M, 72K, 72C and 72Y of the image formation unit 16.

In the present embodiment, the application system using the roller is used to deposit the treatment liquid onto the recording surface of the recording medium 24; however, the present invention is not limited to this, and it is possible to employ a spraying method, an inkjet method, or other methods of various types.

<Image Formation Unit>

The image formation unit 16 is a mechanism which prints an image corresponding to an input image by ejecting and depositing droplets of ink by an inkjet method, and the image formation unit 16 includes an image formation drum 70, a paper pressing roller 74 and the inkjet heads 72M, 72K, 72C and 72Y. The inkjet heads 72M, 72K, 72C and 72Y correspond to inks of four colors: magenta (M), black (K), cyan (C) and yellow (Y), and are disposed in the order of description from the upstream side in the rotation direction of the image formation drum 70.

The image formation drum 70 is a drum that holds the recording medium 24 on the outer circumferential surface thereof and rotationally conveys the recording medium 24. The rotation of the image formation drum 70 is driven and controlled by the below-described motor driver 176 (see FIG. 9). Further, the image formation drum 70 is provided on the outer circumferential surface thereof with a hook-shaped holding device, by which the leading end of the recording medium 24 can be held. In a state in which the leading end of the recording medium 24 is held by the holding device, the image formation drum 70 is rotated to rotationally convey the recording medium 24. In this case, the recording medium 24 is conveyed in a state where the recording surface thereof faces outward, and inks are deposited on the recording surface by the inkjet heads 72M, 72K, 72C and 72Y. The paper pressing roller 74 is a guide member for causing the recording medium 24 to tightly adhere to the outer circumferential surface of the image formation drum 70, and is arranged so as to face the outer circumferential surface of the image formation drum 70. More specifically, the paper pressing roller 74 is disposed to the downstream side of the position where transfer of the recording medium 24 is received, and to the upstream side from the inkjet heads 72M, 72K, 72C and 72Y, in terms of the direction of conveyance of the recording medium 24 (the direction of rotation of the image formation drum 70).

When the recording medium 24 that has been transferred onto the image formation drum 70 from the intermediate conveyance unit 26 is rotationally conveyed in a state where the leading end portion of the recording medium 24 is held by the holding device, the recording medium 24 is pressed by the paper pressing roller 74 to tightly adhere to the outer circumferential surface of the image formation drum 70. When the recording medium 24 has been made to tightly adhere to the outer circumferential surface of the image formation drum 70 in this way, the recording medium 24 is conveyed to a print region directly below the inkjet heads 72M, 72K, 72C and 72Y in a state where the recording medium 24 does not float up at all from the outer circumferential surface of the image formation drum 70.

The inkjet heads 72M, 72K, 72C and 72Y are inkjet heads (inkjet heads) of the inkjet system of the full line type that have a length corresponding to the maximum width of the image formation region in the recording medium 24. A nozzle row is formed on the ink ejection surface of the inkjet head. The nozzle row has a plurality of nozzles arranged therein for discharging ink over the entire width of the image recording region. Each of the inkjet heads 72M, 72K, 72C and 72Y is fixedly disposed so as to extend in the direction perpendicular to the conveyance direction (rotation direction of the image formation drum 70) of the recording medium 24.

Furthermore, each of the inkjet heads 72M, 72K, 72C and 72Y is disposed obliquely to the horizontal plane, in such a manner that each of the nozzle surfaces of the inkjet heads 72M, 72K, 72C and 72Y is substantially parallel to the recording surface of the recording medium 24 held on the outer circumferential surface of the image formation drum 70.

Droplets of corresponding colored inks are ejected from the inkjet heads 72M, 72K, 72C and 72Y having the above-described configuration toward the recording surface of the recording medium 24 held on the outer circumferential surface of the image formation drum 70. As a result, the ink comes into contact with the treatment liquid that has been heretofore applied on the recording surface by the treatment liquid application unit 14, the coloring material (pigment) dispersed in the ink is aggregated, and a coloring material aggregate is formed. Therefore, the coloring material flow on the recording medium 24 is prevented and an image is formed on the recording surface of the recording medium 24. In this case, because the image formation drum 70 of the image formation unit 16 is structurally separated from the treatment liquid drum 54 of the treatment liquid application unit 14, the treatment liquid does not adhere to the inkjet heads 72M, 72K, 72C and 72Y, and the number of factors preventing the ejection of ink can be reduced.

In the present embodiment, the CMYK standard color (four colors) configuration is described, but combinations of ink colors and numbers of colors are not limited to that of the present embodiment, and if necessary, light inks, dark inks, and special color inks may be added. For example, a configuration is possible in which inkjet heads are added that eject light inks such as light cyan and light magenta. The arrangement order of color heads is also not limited.

Although not shown in FIG. 1, the inkjet recording apparatus 10 is provided with a maintenance processing unit 199 (see FIG. 6) including a cleaning processing unit 160 (see FIG. 7) which cleans a nozzle surface 72A (see FIG. 7) of each of the inkjet heads 72M, 72K, 72C and 72Y, and the maintenance processing unit 199 is arranged nearby the image formation drum 70. The maintenance processing unit 199 and the cleaning processing unit 160 will be described below in greater details.

<Drying Unit>

The drying unit 18 dries water included in the solvent separated by the coloring material aggregation action. As shown in FIG. 1, the drying unit includes a drying drum 76 and a solvent dryer 78.

The drying drum 76 is a drum that holds the recording medium 24 on the outer circumferential surface thereof and rotationally conveys the recording medium 24. The rotation of the drying drum 76 is driven and controlled by the below-described motor driver 176 (see FIG. 9). Further, the drying drum 76 is provided on the outer circumferential surface thereof with a hook-shaped holding device, by which the leading end of the recording medium 24 can be held. In a state in which the leading end of the recording medium 24 is held by the holding device, the drying drum 76 is rotated to rotationally convey the recording medium. In this case, the recording medium 24 is conveyed in a state where the recording surface thereof faces outward. The drying treatment is carried out by the solvent dryer 78 with respect to the recording surface of the recording medium 24. The drying drum 76 may be provided with suction apertures on the outer circumferential surface thereof and connected to a suction device that performs suction from the suction apertures. As a result, the recording medium 24 can be held in a state of tight adherence to the outer circumferential surface of the drying drum 76.

The solvent dryer 78 is disposed in a position facing the outer circumferential surface of the drying drum 76, and includes a halogen heater 80. The halogen heater 80 is controlled to blow warm air at a prescribed temperature at a constant blowing rate toward the recording medium 24.

With the solvent dryer 78 of the above-described configuration, water included in the ink solvent on the recording surface of the recording medium 24 held by the drying drum 76 is evaporated, and drying treatment is performed. In this case, because the drying drum 76 of the drying unit 18 is structurally separated from the image formation drum 70 of the image formation unit 16, the number of ink non-ejection events caused by drying of the head meniscus portion by thermal drying can be reduced in the inkjet heads 72M, 72K, 72C and 72Y. Further, there is a degree of freedom in setting the temperature of the drying unit 18, and the optimum drying temperature can be set.

By holding the recording medium 24 in such a manner that the recording surface thereof is facing outward on the outer circumferential surface of the drying drum 76 having this composition (in other words, in a state where the recording surface of the recording medium 24 is curved in a convex shape), and drying while conveying the recording medium in rotation, it is possible to prevent the occurrence of wrinkles or floating up of the recording medium 24, and therefore drying non-uniformities caused by these phenomena can be prevented reliably.

<Fixing Unit>

The fixing unit 20 includes a fixing drum 84, a halogen heater 86, a fixing roller 88, and an inline sensor 90. The halogen heater 86, the fixing roller 88, and the inline sensor 90 are arranged in positions opposite the outer circumferential surface of the fixing drum 84 in this order from the upstream side in the rotation direction (counterclockwise direction in FIG. 1) of the fixing drum 84.

The fixing drum 84 a drum that holds the recording medium 24 on the outer circumferential surface thereof and rotationally conveys the recording medium 24. The rotation of the fixing drum 84 is driven and controlled by the below-described motor driver 176 (see FIG. 9). The fixing drum 84 has a hook-shaped holding device, and the leading end of the recording medium 24 can be held by this holding device. The recording medium 24 is rotationally conveyed by rotating the fixing drum 84 in a state in which the leading end of the recording medium 24 is held by the holding device. In this case, the recording medium 24 is conveyed in a state where the recording surface thereof faces outward, and the preheating by the halogen heater 86, the fixing treatment by the fixing roller 88 and the inspection by the inline sensor 90 are performed with respect to the recording surface. The fixing drum 84 may be provided with suction apertures on the outer circumferential surface thereof and connected to a suction device that performs suction from the suction apertures. As a result, the recording medium 24 can be held in a state of tight adherence to the outer circumferential surface of the fixing drum 84.

The halogen heater 86 is controlled to a prescribed temperature, by which the preheating is performed with respect to the recording medium 24. The fixing roller 88 is a roller member which applies heat and pressure to the dried ink to melt and fix the self-dispersible polymer particles in the ink so as to transform the ink into the film More specifically, the fixing roller 88 is arranged so as to be pressed against the fixing drum 84, and a nip roller is configured between the fixing roller 88 and the fixing drum 84. As a result, the recording medium 24 is squeezed between the fixing roller 88 and the fixing drum 84, nipped under a prescribed nip pressure, and subjected to fixing treatment.

Further, the fixing roller 88 is configured by a heating roller in which a halogen lamp is incorporated in a metal pipe, for example made from aluminum, having good thermal conductivity and the rollers are controlled to a prescribed temperature. Where the recording medium 24 is heated with the heating roller, thermal energy not lower than a Tg temperature (glass transition temperature) of a latex included in the ink is applied and latex particles are melted. As a result, fixing is performed by penetration into the projections-recessions of the recording medium 24, the projections-recessions of the image surface are leveled out, and gloss is obtained.

The fixing unit 20 is provided with the single fixing roller 88 in the above-described embodiment; however, it is possible that a plurality of fixing rollers 88 depending on the thickness of image layer and Tg characteristic of latex particles. Furthermore, the surface of the fixing drum 84 may be controlled to a prescribed temperature.

On the other hand, the inline sensor 90 is a measuring device which measures the check pattern, moisture amount, surface temperature, gloss, and the like of the image fixed to the recording medium 24. A CCD sensor or the like can be used for the inline sensor 90.

With the fixing unit 20 of the above-described configuration, the latex particles located within a thin image layer formed in the drying unit 18 are melted by application of heat and pressure by the fixing roller 88. Thus, the latex particles can be reliably fixed to the recording medium 24. In addition, with the fixing unit 20, the fixing drum 84 is structurally separated from other drums. Therefore, the temperature of the fixing unit 20 can be freely set separately from the image formation unit 16 and the drying unit 18.

<Discharge Unit>

As shown in FIG. 1, the discharge unit 22 is provided after the fixing unit 20. The discharge unit 22 includes a discharge tray 92, and a transfer body 94, a conveying belt 96, and a tension roller 98 are provided between the discharge tray 92 and the fixing drum 84 of the fixing unit 20 so as to face the discharge tray 92 and the fixing drum 84. The recording medium 24 is fed by the transfer body 94 onto the conveying belt 96 and discharged onto the discharge tray 92.

<Intermediate Conveyance Unit>

The structure of the first intermediate conveyance unit 26 will be described below. The second intermediate conveyance unit 28 and the third intermediate conveyance unit 30 are configured identically to the first intermediate conveyance unit 26 and the explanation thereof will be omitted.

The first intermediate conveyance unit 26 is provided with an intermediate conveyance body 32, which is a drum for receiving the recording medium 24 from a drum of a previous stage, rotationally conveying the recording medium 24, and transferring it to a drum of the subsequent stage, and is mounted to be capable of rotating freely. The intermediate conveyance body 32 is rotated by a motor 188 (not shown in FIG. 1 and shown in FIG. 9), and the rotation thereof is driven and controlled by the below-described motor driver 176 (see FIG. 9). Further, the intermediate conveyance body 32 is provided on the outer circumferential surface thereof with a hook-shaped holding device, by which the leading end of the recording medium 24 can be held. In a state in which the leading end of the recording medium 24 is held by the holding device, the intermediate conveyance body 32 is rotated to rotationally convey the recording medium 24. In this case, the recording medium 24 is conveyed in a state where the recording surface thereof faces inward, whereas the non-recording surface thereof faces outward.

The recording medium 24 conveyed by the first intermediate conveyance unit 26 is transferred to a drum of the subsequent stage (that is, the image formation drum 70). In this case, the transfer of the recording medium 24 is performed by synchronizing the holding device of the intermediate conveyance unit 26 and the holding device (the gripper 102) of the image formation unit 16. The transferred recording medium 24 is held by the image formation drum 70 and rotationally conveyed.

<Structure of Inkjet Heads>

Next, the structure of the inkjet heads is described. The inkjet heads 72M, 72K, 72C and 72Y for the respective colored inks have the same structure, and a reference numeral 72 is hereinafter designated to any of the inkjet heads (hereinafter also referred to simply as the heads).

Figure 2:
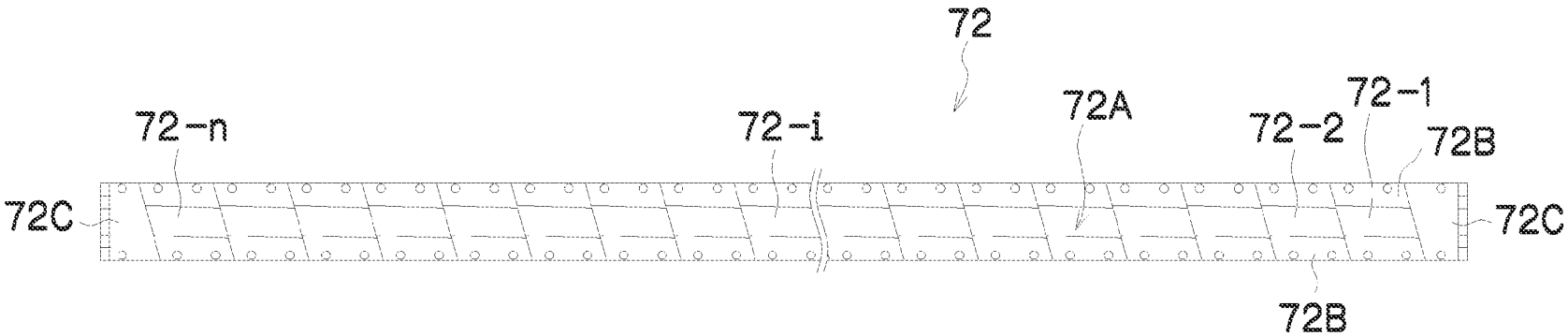
FIG. 2 is a plan view diagram showing an embodiment of the composition of an inkjet head in FIG. 1.
Figure 3:
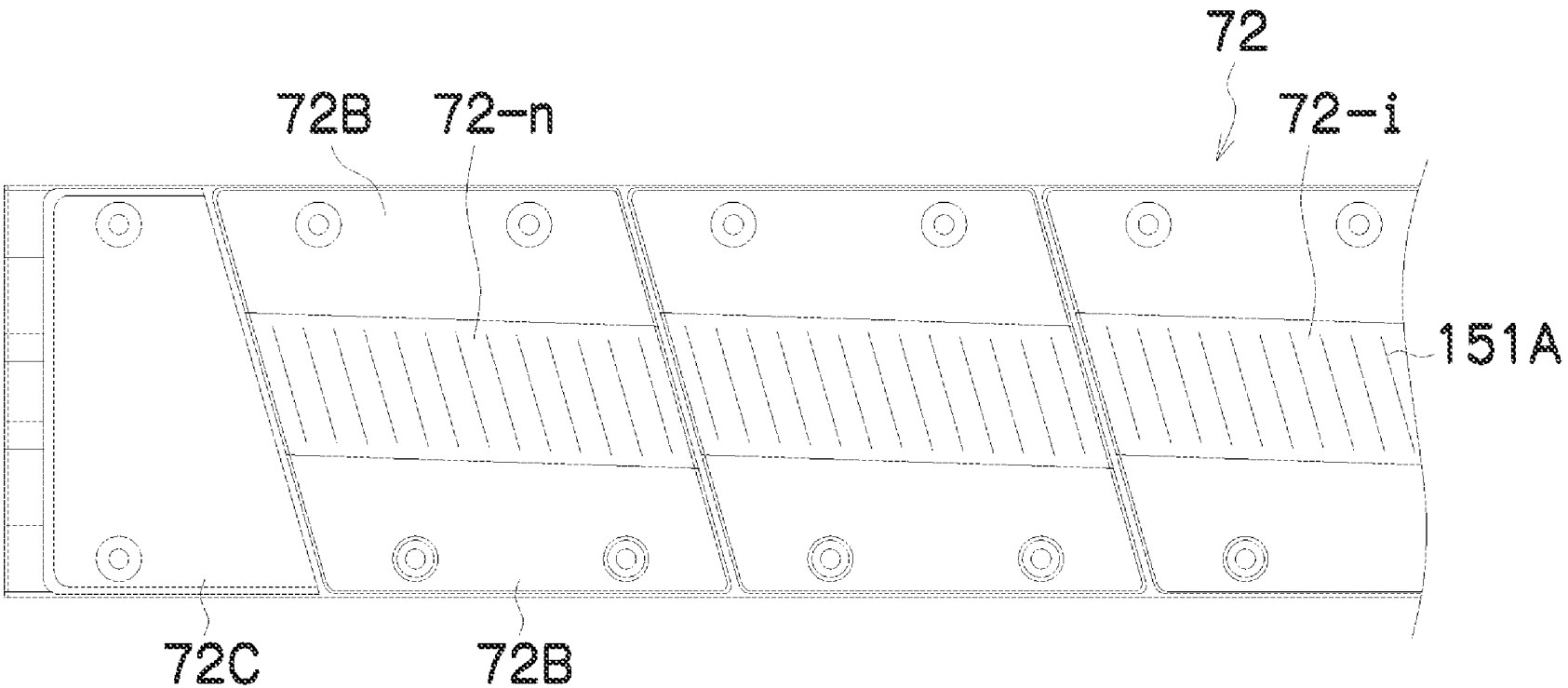
FIG. 3 is a partial enlarged view of FIG. 2.

FIG. 2 is a plan diagram showing an embodiment of the structure of the head 72, and depicts the head 72 as viewed from the side of the nozzle surface 72A. FIG. 3 is a partial enlarged diagram of FIG. 2.

As shown in FIG. 2, the head 72 has a structure in which n head modules 72-*i* (i=1, 2, 3, . . . , n) are joined together in the lengthwise direction (the direction perpendicular to the direction of conveyance of the recording medium 24 (see FIG. 1)), and a plurality of nozzles 151 (not shown in FIG. 2, and shown in FIGS. 4A to 4C) are arranged through a length corresponding to the full width of the recording medium 24.

The head modules 72-*i* are supported by head module supporting members 72B from either side in the breadthways direction of the head 72. Furthermore, the end portions of the head 72 in the lengthwise direction are supported by head supporting members 72C.

As shown in FIG. 3, each head module 72-*i* (n-th head module 72-*n*) has a structure in which the nozzles 151 (not shown in FIG. 3, and shown in FIGS. 4A to 4C) are arranged in a matrix configuration. In FIG. 3, the oblique solid lines denoted with reference numeral 151A represent the nozzle columns in which the nozzles are arranged in one column.

Figure 4A:
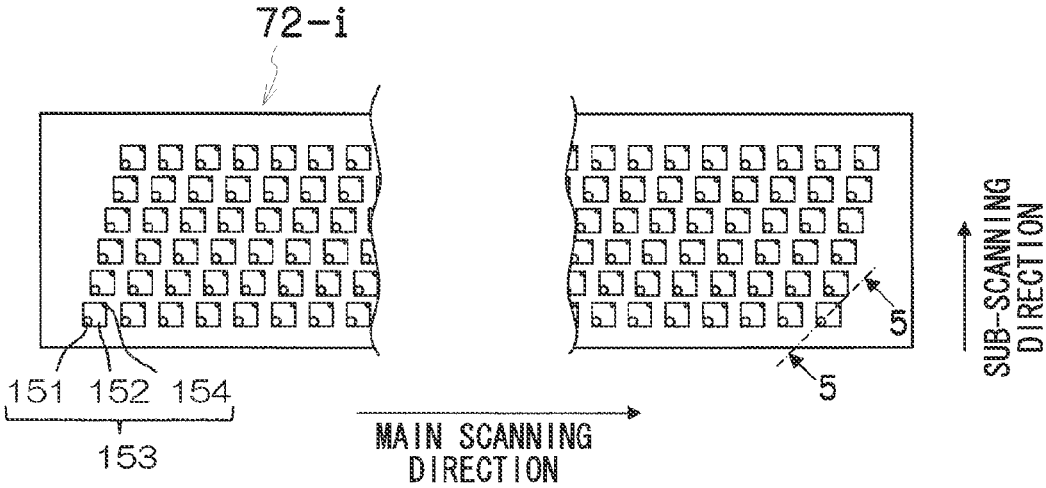
FIGS. 4A to 4C are plan view perspective diagrams of a head module in FIG. 2.
Figure 4B:
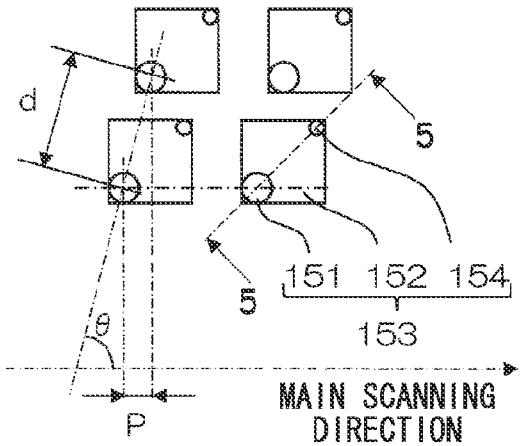
Figure 4C:
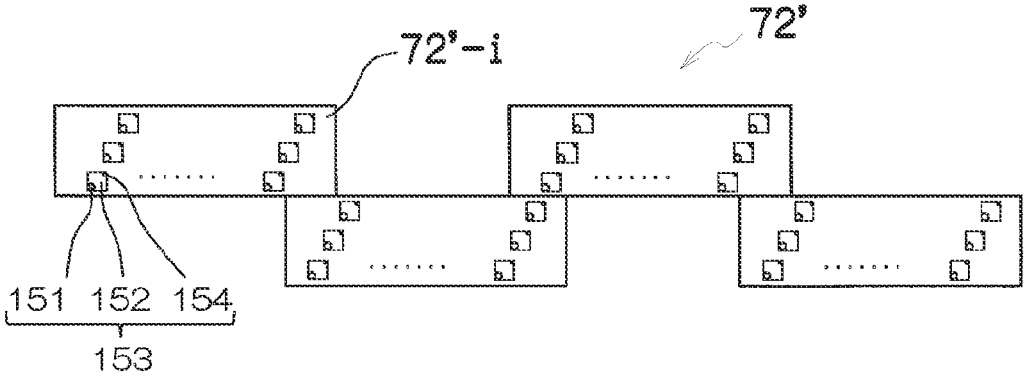
Figure 5:
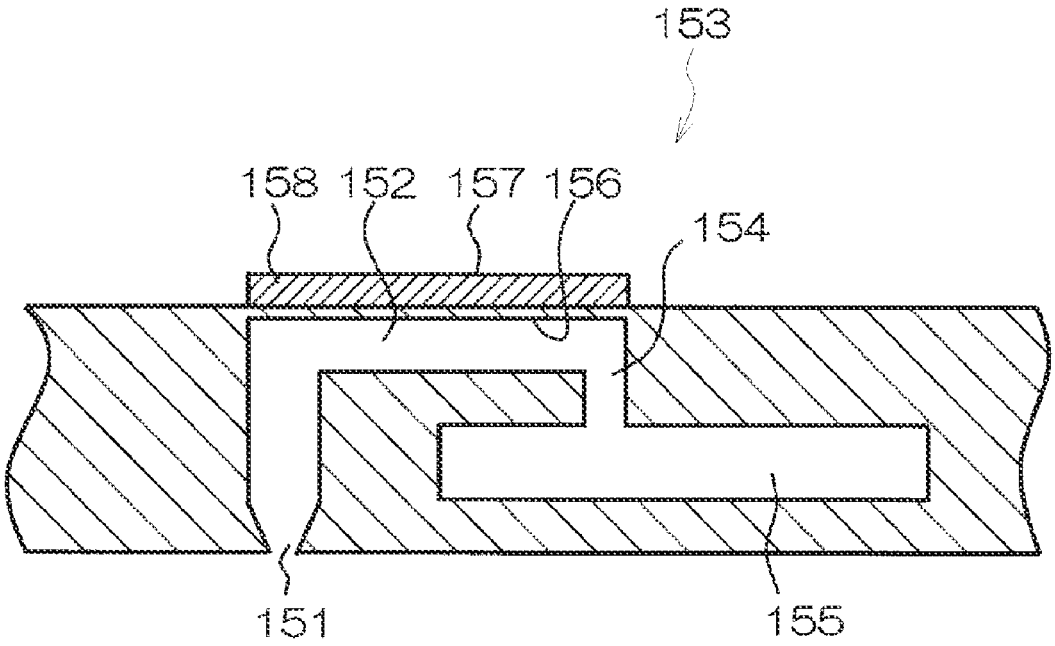
FIG. 5 is a cross-sectional diagram showing the inner composition of an ink chamber unit.

FIG. 4A is a perspective plan view showing an embodiment of the configuration of the head module 72-*i*, FIG. 4B is an enlarged view of a portion thereof, and FIG. 4C is a perspective plan view showing another embodiment of the configuration of the head 72. FIG. 5 is a cross-sectional view taken along the line 5-5 in FIGS. 4A and 4B, showing the inner structure of an ink chamber unit in the head module 72-*i*.

The nozzle pitch in the head 72 should be minimized in order to maximize the density of the dots printed on the surface of the recording medium 24. As shown in FIGS. 4A and 4B, the head module 72-*i* according to the present embodiment has a structure in which a plurality of ink chamber units (i.e., droplet ejection units serving as recording units) 153, each having a nozzle 151 forming an ink ejection aperture, a pressure chamber 152 corresponding to the nozzle 151, and the like, are disposed two-dimensionally in the form of a staggered matrix, and hence the effective nozzle interval (the projected nozzle pitch) as projected in the lengthwise direction of the head 150 (the main scanning direction: the direction perpendicular to the conveyance direction of the recording medium 24) is reduced and high nozzle density is achieved.

The mode of forming one or more nozzle rows through a length corresponding to the entire width of the recording medium 24 in the main scanning direction substantially perpendicular to the conveyance direction of the recording medium 24 (the sub-scanning direction) is not limited to the embodiment described above. For example, instead of the configuration in FIG. 4A, as shown in FIG. 4C, a line head 72' having nozzle rows of a length corresponding to the entire width of the recording medium 24 can be formed by arranging and combining, in a staggered matrix, short head blocks 72'-*i* having a plurality of nozzles 151 arrayed in a two-dimensional fashion.

The planar shape of the pressure chamber 152 provided for each nozzle 151 is substantially a square, and the nozzle 151 and an ink supply port 154 are disposed in both corners on a diagonal line of the square. The shape of the pressure chamber 152 is not limited to that of the present embodiment, and a variety of planar shapes, for example, a polygon such as a rectangle (rhomb, rectangle, etc.), a pentagon and a heptagon, a circle, and an ellipse can be employed.

As shown in FIG. 5, each pressure chamber 152 is connected to a common channel 155 through the supply port 154. The common channel 155 is connected to an ink tank (not shown), which is a base tank for supplying ink, and the ink supplied from the ink tank is delivered through the common flow channel 155 to the pressure chambers 152.

A piezoelectric element 158 provided with an individual electrode 157 is bonded to a diaphragm 156, which forms a face (the upper face in FIG. 5) of the pressure chamber 152 and also serves as a common electrode. When a drive voltage is applied to the individual electrode 157, the piezoelectric element 158 is deformed, the volume of the pressure chamber 152 is thereby changed, and the ink is ejected from the nozzle 151 by the variation in pressure that follows the variation in volume. When the piezoelectric element 158 returns to the original state after the ink has been ejected, the pressure chamber 152 is refilled with new ink from the common channel 155 through the supply port 154.

The present embodiment applies the piezoelectric elements 158 as ejection power generation devices to eject the ink from the nozzles 151 arranged in the head 72; however, instead, a thermal system that has heaters within the pressure chambers 152 to eject the ink using the pressure resulting from film boiling by the heat of the heaters can be applied.

As shown in FIG. 4B, the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the ink chamber units 153 are arranged at a uniform pitch d in line with a direction forming the angle of θ with respect to the main scanning direction, the pitch P of the nozzles projected so as to align in the main scanning direction is d×cos θ, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the embodiments shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 24 is moved in the breadthways direction (main scanning direction) of the recording medium 24, thereby performing printing in the breadthways direction, and when one printing action in the breadthways direction has been completed, the recording medium 24 is moved through a prescribed amount in the sub-scanning direction perpendicular to the breadthways direction, printing in the breadthways direction of the recording medium 24 is carried out in the next printing region, and by repeating this sequence, printing is performed over the whole surface of the printing region of the recording medium 24.

Description of Maintenance Unit

Figure 6:
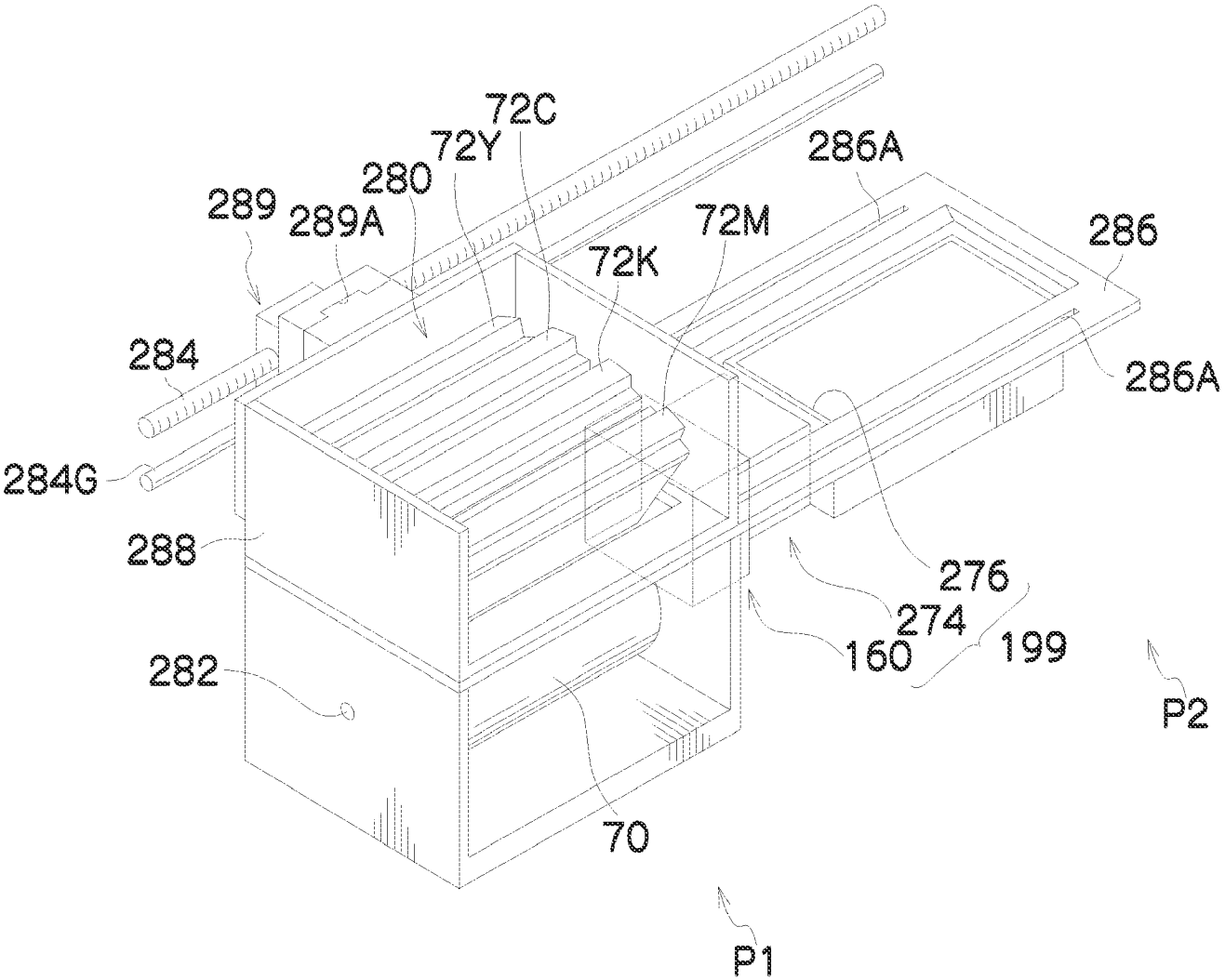
FIG. 6 is a general schematic drawing of a maintenance processing unit according to an embodiment of the present invention.

FIG. 6 is a perspective diagram of the maintenance processing unit 199 arranged adjacently to the print unit 16. As shown in FIG. 5, the maintenance processing unit 199 for carrying out maintenance processing of the inkjet heads 72M, 72K, 72C and 72Y is arranged on the outside of the image formation drum 70 of the print unit 16, adjacently to the image formation drum 70 in the axial direction of the image formation drum 70.

The maintenance processing unit 199 is provided with the cleaning processing unit 160, a wiping unit 274 and a nozzle cap 276 disposed in this order from the side near the image formation drum 70.

A head unit 280 mounted with ink droplet ejection heads 72M, 72K, 72C and 72Y corresponding to the respective colors is engaged to a ball screw 284, which is disposed in parallel with the rotational axle 282 of the image formation drum 70. A guide shaft 284G is disposed in parallel with the ball screw 284, on the lower side of the ball screw 284, and the head unit 280 engages slidably with this guide shaft 284G A guide rail member 286 having guide grooves 286A, which guide the movement of the head unit 280, is disposed in parallel with the ball screw 284, on the lower side of the head unit 280.

The head unit 280 has a frame body 288, which integrally holds the inkjet heads 72M, 72K, 72C and 72Y. Engaging parts (not shown) are projectingly formed on the lower surface of the frame body 288, and slidably engage with the guide grooves 286A, whereby the head unit 280 is able to move by being guided by the guide grooves 286A.

As shown in FIG. 6, the ball screw 284, the guide shaft 284G and the guide rail member 286 are arranged extending in the axial direction of the image formation drum 70 through a prescribed length, in such a manner that the head unit 280 can be moved from an image forming position P1 above the image formation drum 70 to a maintenance position P2 facing the nozzle cap 276.

The ball screw 284 is rotated by a drive device such as a motor (not shown), and due to this rotation, the head unit 280 is moved between the image forming position P1 and the maintenance position P2. Furthermore, the head unit 280 can be moved in a direction away from the image formation drum 70 or in a direction toward the image formation drum 70, by means of an upward/downward movement mechanism (not shown).

The height of the head unit 280 with respect to the surface of the image formation drum 70 (namely, the clearance between the recording surface of the recording medium 24 and the respective inkjet heads 72M, 72K, 72C and 72Y) is controlled in accordance with the thickness of the recording medium 24 used. Furthermore, if a jam, or the like, occurs during conveyance of the recording medium, then the head unit 280 can be moved upward in FIG. 6 and thereby withdrawn from the prescribed height position during image formation.

As shown in FIG. 6, a coupling portion 289 between the frame body 288 of the head unit 280 and the ball screw 284 and the guide shaft 284G employs a linearly movable engagement structure 289A, which guides the upward and downward movement of the head unit 280.

Description of Cleaning Processing Unit

The cleaning processing unit 160 shown in FIG. 6 is hereby described.

<General Composition of Cleaning Processing Unit>

Figure 7:
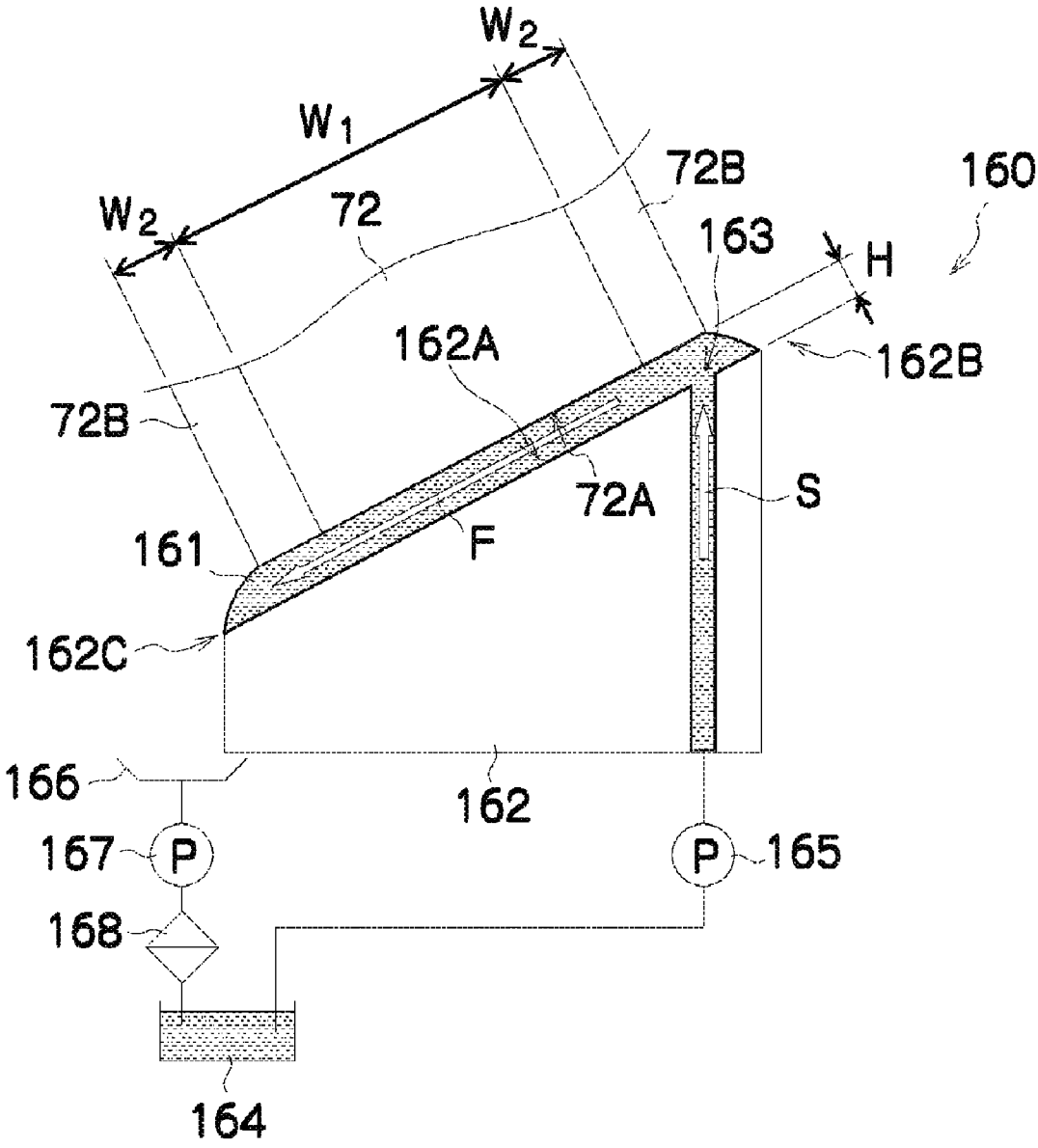
FIG. 7 is a general schematic drawing of a cleaning liquid application unit in FIG. 6.

FIG. 7 is a general schematic drawing of the cleaning processing unit 160, viewed from the breadthways direction (the sub-scanning direction) of a full line type of inkjet head 72, and the direction perpendicular to the sheet of the drawing is the lengthwise direction of the inkjet head 72 (i.e., the main scanning direction perpendicular to the recording medium conveyance direction).

The cleaning processing unit 160 includes: a cleaning liquid application unit 162 having a cleaning liquid holding surface 162A, on which the cleaning liquid to be applied onto the nozzle surface 72A of the head 72 is held; a cleaning liquid tank 164, which stores the cleaning liquid to be supplied to the cleaning liquid unit 162; and a pump 165, which controls the amount of the cleaning liquid supplied to the cleaning liquid holding surface 162A (the amount of the cleaning liquid supplied per unit time). The cleaning liquid application unit 162 has a cleaning liquid supply port 163, through which the cleaning liquid is supplied to the cleaning liquid holding surface 162A, arranged in the vicinity of the upper end of an upper portion 162B of the inclined cleaning liquid holding surface 162A.

A slight amount of cleaning liquid which has flown in between the nozzle surface 72A of the head 72 and the cleaning liquid holding surface 162A from the cleaning liquid supply port 163 wets the surfaces and spreads due to the liquid repelling properties of the nozzle surface 72A, and slides down the inclined cleaning liquid holding surface 162A while forming a meniscus between the nozzle surface 72A and the cleaning liquid holding surface 162A. An outlined arrow F in FIG. 7 indicates the direction of movement of a coating layer 161 of the cleaning liquid (in the lower-left direction in FIG. 7). The cleaning liquid that has slid down the inclined cleaning liquid holding surface 162A falls into a recovery tray 166 arranged below a lower portion 162C of the inclined cleaning liquid holding surface 162A. When a pump 167 is driven, the used cleaning liquid which is collected in the recovery tray 166 is sent to the cleaning liquid tank 164 through a filter 168, and is reused.

In order that the cleaning liquid slides down the inclined cleaning liquid holding surface 162A while forming the meniscus between the nozzle surface 72A and the cleaning liquid holding surface 162A, it is necessary to optimize the surface properties of the nozzle surface 72A and the cleaning liquid holding surface 162A (to make the cleaning liquid have appropriate contact angles with respect to the surfaces), the properties (e.g., viscosity) of the cleaning liquid, the flow speed (supply rate per unit time) of the cleaning liquid, and the shape and size of the cleaning liquid supply port 163.

In the present embodiment, the contact angle of the cleaning liquid with respect to the nozzle surface 72A is 60 degrees, the contact angle of the cleaning liquid with respect to the cleaning liquid holding surface 162A is 80 degrees, the viscosity of the cleaning liquid is 2.3 cP, the flow rate per unit time of the cleaning liquid is 28 ml/sec, the shape of the cleaning liquid supply port is substantially a circle having the diameter of 1 mm, the length of the cleaning liquid holding surface 162A in the lengthwise direction of the head is 4 mm, and the inclination of the cleaning liquid holding surface 162A with respect to the horizontal plane is 24 degrees.

Under the conditions described above, if the distance H between the nozzle surface 72A and the cleaning liquid holding surface 162A is set to 1.5 mm and the cleaning liquid is supplied between the nozzle surface 72A and the cleaning liquid holding surface 162A, then the cleaning liquid has a flow speed of approximately 80 mm/sec, and moves while wetting the surfaces and spreading between the nozzle surface 72A and the cleaning liquid holding surface 162A.

By controlling the amount of cleaning liquid supplied in such a manner that the flow speed of the cleaning liquid is not lower than 80 mm/sec and not higher than 150 min/sec, the cleaning liquid is made to move while wetting the surfaces and spreading between the nozzle surface 72A and the cleaning liquid holding surface 162A, and the nozzle surface can be cleaned with a small amount of cleaning liquid.

Furthermore, if the distance H between the nozzle surface 72A and the cleaning liquid holding surface 162A is not smaller than 1 mm and not greater than 2 mm, then the cleaning liquid moves at a similar flow speed to that stated above, while wetting the surfaces and spreading between the nozzle surface 72A and the cleaning liquid holding surface 162A.

The cleaning liquid holding surface 162A can be made of a metal material (for example, stainless steel) or a resin material. A desirable mode is one where the cleaning liquid holding surface 162A has the surface properties whereby the contact angle of the cleaning liquid with respect to the cleaning liquid holding surface 162A is not smaller than 80 degrees. The cleaning liquid holding surface 162A may be oblique to the nozzle surface 72A, provided that it can maintain a prescribed distance with respect to the nozzle surface 72A, and the cleaning liquid holding surface 162A may also be a spherical surface, a cylindrical surface or a curved surface, rather than a flat surface, provided that the distance H between the nozzle surface 72A and the cleaning liquid holding surface 162A is not smaller than 1 mm and not greater than 2 mm.

The length from the cleaning liquid supply port 163 to the lower portion 162C of the inclined cleaning liquid holding surface 162A should at least exceed the dimension $W_1$ in the breadthways direction (direction of inclination) of the head 72 of the nozzle arrangement region in which the nozzles are arranged in the head 72 (nozzle surface 72A), and more desirably, exceeds the sum of the dimension $W_1$ and the dimensions $W_2$ of the head module supporting member 72B on both sides (i.e., $W_1+W_2\times2$).

FIG. 7 shows the mode where the cleaning liquid supply port 163 is arranged on the uppermost portion of the inclined cleaning liquid holding surface 162A; however, it is sufficient that the cleaning liquid supply port 163 is on the upper side of the inclination with respect to the nozzle arrangement region in which the nozzles 151 are arranged (see FIGS. 4A to 4C). Furthermore, it is sufficient that at least one cleaning liquid supply port 163 is arranged in the lengthwise direction of the head 72, but it is also possible to arrange a plurality of cleaning liquid supply ports 163 in the lengthwise direction of the head 72.

The planar shape of the opening of the cleaning liquid supply port 163 is the circle having the diameter of 1 mm in the present embodiment. The planar shape of the cleaning liquid supply port 163 can be a shape other than the circle, such as an ellipse, a quadrilateral, or other polygonal shapes, or the like. Furthermore, the size of the cleaning liquid supply port 163 is specified appropriately in accordance with the physical properties of the cleaning liquid, and the like.

The cleaning liquid supply port 163 connects to an internal flow channel (not shown) formed inside the cleaning liquid application unit 162. The flow channel is connected to the pump 165 through a cleaning liquid inlet port (not shown) arranged in the bottom face of the cleaning liquid application unit 162 and a prescribed external flow channel connecting to the cleaning liquid inlet port. The pump 165 is connected to the cleaning liquid tank 164 through a prescribed external flow channel, and functions as a device for controlling the supply amount of the cleaning liquid. When the pump 165 is driven, the cleaning liquid is raise from the cleaning liquid tank 164 and a prescribed amount of cleaning liquid is supplied to the cleaning liquid supply port 163. An outlined arrows S in FIG. 7 indicates the direction of movement of the cleaning liquid inside the cleaning liquid application unit 162.

The cleaning liquid can be applied over the whole of the nozzle surface 72A of the head 72 by moving the head 72 in the lengthwise direction (the direction perpendicular to the sheet of the drawing in FIG. 7) while the cleaning liquid application unit 162 having the aforementioned structure maintains a state of holding the cleaning liquid 161 between the nozzle surface 72A and the cleaning liquid holding surface 162A.

If the speed of movement of the head 72 is 10 min/sec, then the cleaning liquid is deposited uniformly over the whole of the nozzle surface 72A, and the flow speed of the cleaning liquid between the nozzle surface 72A and the cleaning liquid holding surface 162A is substantially the same as that described above.

The liquid employed for the cleaning liquid can be a special liquid having a high cleaning effect, which has properties for dissolving solidified ink adhering to the nozzle surface 72A, and properties for forming the coating layer 161 of the cleaning liquid on the cleaning liquid holding surface 162A. For example, it is possible to employ a cleaning liquid which includes a solvent, such as DEGmBE (diethylene glycol monobutyl ether).

Figure 8:
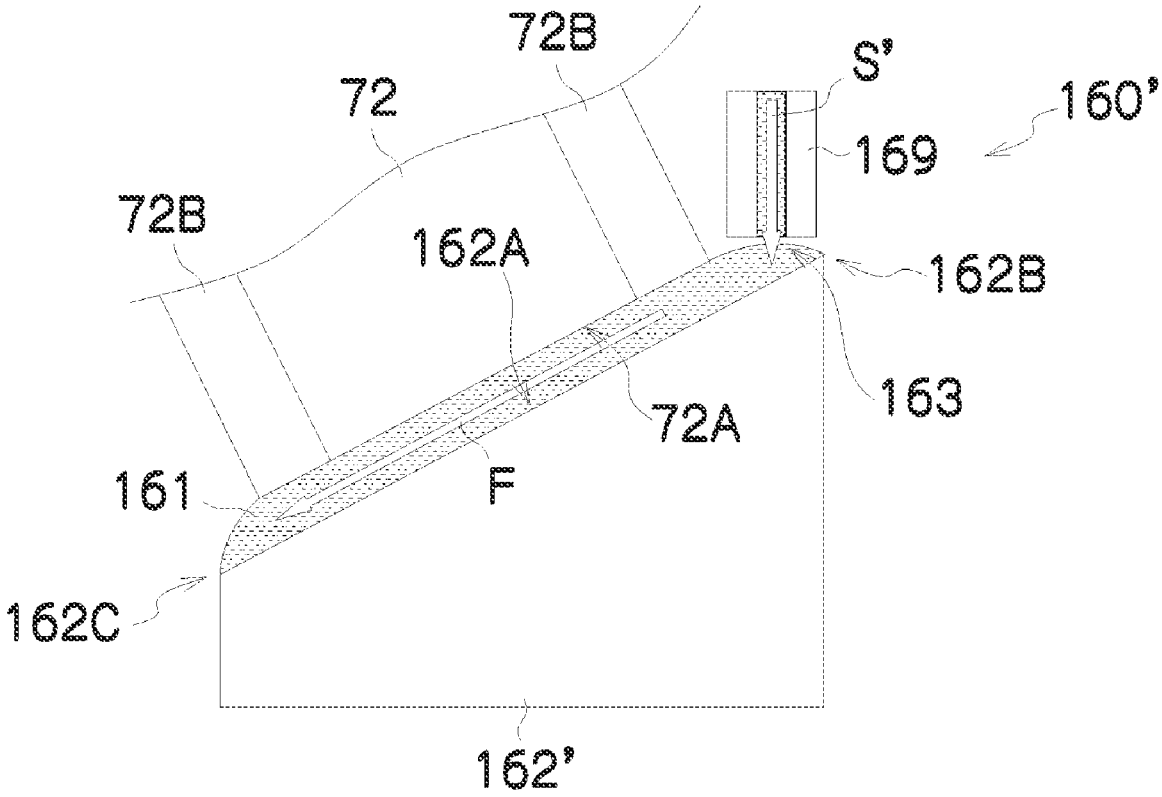
FIG. 8 is a general schematic drawing of another mode of the cleaning liquid application unit in FIG. 7.

FIG. 8 is a general schematic drawing of a cleaning processing unit 160' composed so as to supply the cleaning liquid from the side of the surface opposing the cleaning liquid holding surface 162A (i.e., the nozzle surface 72A side of the head 72) to the cleaning liquid holding surface 162A. In FIG. 8, parts which are the same as or similar to FIG. 7 are denoted with the same reference numerals and further explanation thereof is omitted here.

The cleaning liquid application unit 162' shown in FIG. 8 A is provided with a cleaning liquid supply unit 169 arranged at a position opposing the upper portion of the inclined cleaning liquid holding surface 162A. A cleaning liquid supply port 163 is arranged in the surface of the cleaning liquid supply unit 169 facing the cleaning liquid holding surface 162A. An outlined arrow S' in FIG. 8 indicates the direction of movement of the cleaning liquid inside the cleaning liquid supply unit 169 (the downward direction in FIG. 8).

Although not shown in FIG. 8, the cleaning liquid tank 164, the pump 165, the recovery tray 166, the pump 167, the filter 168, and the like are appended to the cleaning liquid supply unit 169 shown in FIG. 8.

Apart from the fact that cleaning liquid is supplied from the face opposing the cleaning liquid holding surface 162A, the cleaning liquid application unit 162' shown in FIG. 8 is the same as the cleaning liquid application unit 162 shown in FIG. 7; a slight amount of cleaning liquid is supplied between the nozzle surface 72A and the cleaning liquid holding surface 162A from the cleaning liquid supply port 163, the cleaning liquid moves from the upper portion to the lower portion of the inclination while wetting the surfaces and spreading between the nozzle surface 72A and the cleaning liquid holding surface 162A, and the cleaning liquid is thereby applied uniformly through the breadthways direction of the nozzle surface 72A.

Description of Control System

Figure 9:
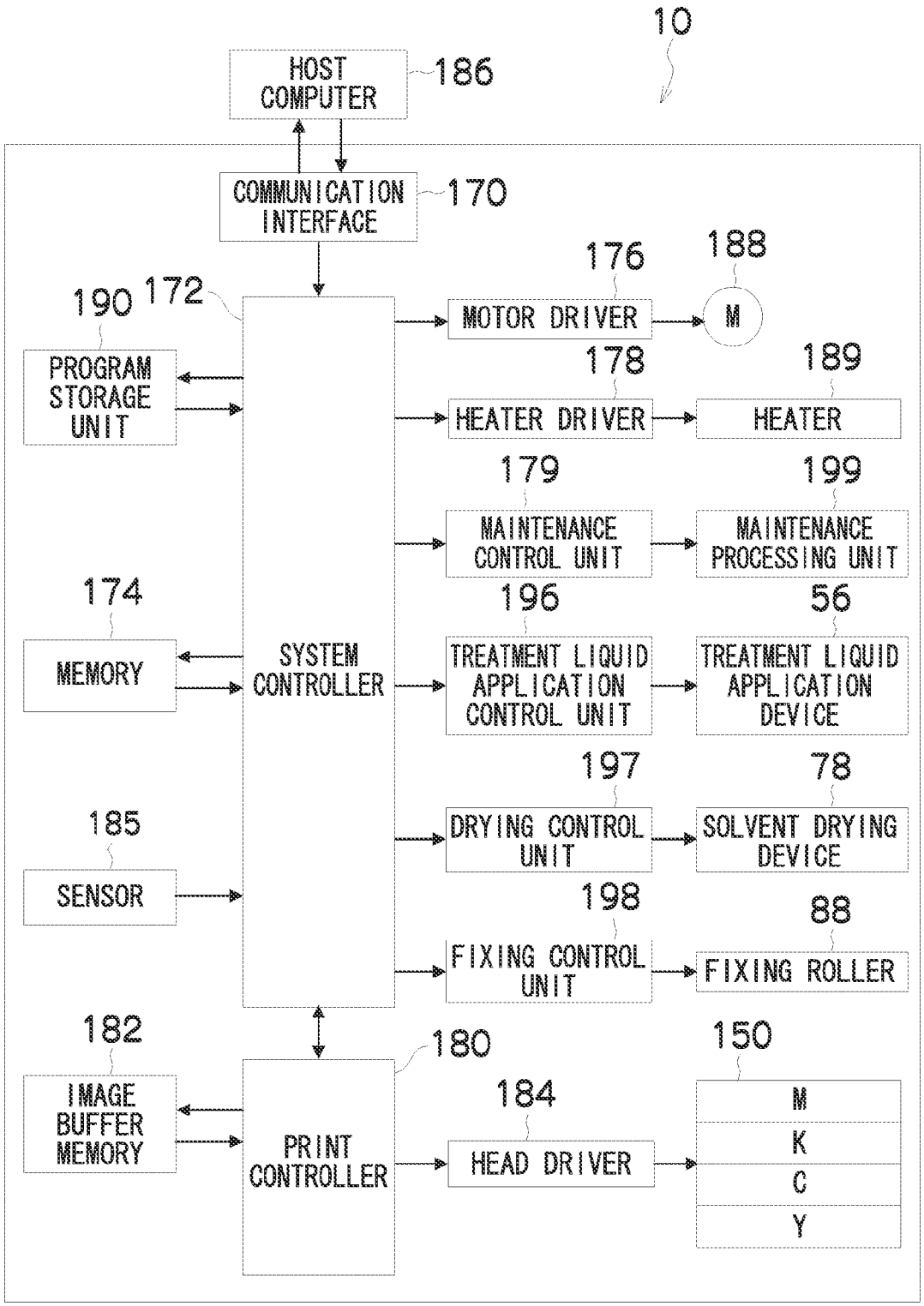
FIG. 9 is a principal block diagram showing the system configuration of the inkjet image recording apparatus in FIG. 1.

FIG. 9 is a block diagram of the main portion of a system configuration of the inkjet recording apparatus 10. The inkjet recording apparatus 10 includes a communication interface 170, a system controller 172, a memory 174, the motor driver 176, a heater driver 178, a maintenance control unit 179, a printing control unit 180, an image buffer memory 182, a head driver 184, a sensor 185, a program storage unit 190, a treatment liquid application control unit 196, a drying control unit 197, and a fixing control unit 198. The communication interface 170 is an interface unit that receives image data sent from a host computer 186. A serial interface such as USB (Universal Serial Bus), IEEE 1394, Ethernet, and a wireless network, or a parallel interface such as Centronix can be applied as the communication interface 170. A buffer memory (not shown) may be installed in the part of the interface to increase the communication speed. The image data sent from the host computer 186 are introduced into the inkjet recording apparatus 10 through the communication interface 170 and temporarily stored in the memory 174.

The memory 174 is a storage device that temporarily stores the images inputted through the communication interface 170 and reads/writes the data via the system controller 172. The memory 174 is not limited to a memory composed of semiconductor elements and may use a magnetic medium such as a hard disk.

The system controller 172 includes a central processing unit (CPU) and a peripheral circuitry thereof, functions as a control device that controls the entire inkjet recording apparatus 10 according to a predetermined program, and also functions as an operational unit that performs various computations. Thus, the system controller 172 controls various units such as the communication interface 170, the memory 174, the motor driver 176, the heater driver 178, the maintenance control unit 179, the treatment liquid application control unit 196, the drying control unit 197 and the fixing control unit 198, performs communication control with the host computer 180, performs read/write control of the memory 174, and also generates control signals for controlling the various units.

Programs that are executed by the CPU of the system controller 172 and various data necessary for performing the control are stored in the memory 174. The memory 174 may be a read-only storage device or may be a writable storage device such as EEPROM. The memory 174 can be also used as a region for temporary storing image data, a program expansion region, and a computational operation region of the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. The program storage unit 190 may be provided with an external interface, and a memory card or PC card may also be used. Naturally, a plurality of these storage media may also be provided. The program storage unit 190 may also be combined with a storage device for storing operational parameters, and the like (not shown).

The motor driver 176 drives a motor 188 in accordance with commands from the system controller 172. In FIG. 9, the plurality of motors disposed in the respective sections of the inkjet recording apparatus 10 are represented by the reference numeral 188. For example, the motor 188 shown in FIG. 9 includes the motors that drive the paper transfer drum 52, the treatment liquid drum 54, the image formation drum 70, the drying drum 76, the fixing drum 84 and the transfer body 94 shown in FIG. 1, and the motors that drive the intermediate conveyance bodies 32 in the first, second and third intermediate conveyance units 26, 28 and 30.

The heater driver 178 is a driver that drives the heater 189 in accordance with commands from the system controller 172. In FIG. 9, the plurality of heaters disposed in the inkjet recording apparatus 10 are represented by the reference numeral 189. For example, the heater 189 shown in FIG. 9 includes the halogen heaters 80 in the solvent dryer 78 arranged in the drying unit 18 shown in FIG. 1, and the heaters that heat the surfaces of the drying drum 76 and the fixing drum 84 shown in FIG. 1.

The treatment liquid application control unit 196, the drying control unit 197 and the fixing control unit 198 control the operations of the treatment liquid application device 56, the solvent dryer 78 and the fixing roller 88, respectively, in accordance with commands from the system controller 172.

The printing control unit 180 has a signal processing function for performing a variety of processing and correction operations for generating signals for print control from the image data within the memory 174 according to control of the system controller 172, and supplies the generated printing data (dot data) to the head driver 184. The required signal processing is implemented in the printing control unit 180, and the ejection amount and ejection timing of droplets in the heads 72 are controlled through the head driver 184 based on the image data. As a result, the desired dot size and dot arrangement are realized.

The printing control unit 180 is provided with the image buffer memory 182, and data such as image data or parameters are temporarily stored in the image buffer memory 182 during image data processing in the printing control unit 180. A mode is also possible in which the printing control unit 180 and the system controller 172 are integrated and configured by one processor.

The head driver 184 generates drive signals for driving the piezoelectric elements 158 of the heads 72, on the basis of the dot data supplied from the print controller 180, and drives the piezoelectric elements 158 by applying the generated drive signals to the piezoelectric elements 158. A feedback control system for maintaining constant drive conditions in the inkjet heads 72 may be included in the head driver 184 shown in FIG. 9.

The sensor 185 represents the sensors disposed in the respective sections of the inkjet recording apparatus 10. For example, the sensor 185 includes the inline sensor 90 shown in FIG. 1, temperature sensors, position determination sensors, and pressure sensors. The output signals of the sensor 185 are sent to the system controller 172, and the system controller 172 controls the respective sections of the inkjet recording apparatus 10 by sending the command signals to the respective sections in accordance with the output signals of the sensor 185.

The maintenance control unit 179 is a processing block that controls the maintenance processing unit 199 (see FIG. 6) including the cleaning processing unit 160 or 160' shown in FIG. 7 or 8, in accordance with control signals supplied from the system controller 172. Furthermore, the maintenance control unit 179 has a function for sending, to the respective units, control signals relating to the implementation of maintenance processing, such as preliminary ejection, suction, or the like, for expelling degraded ink inside the nozzles to the exterior of the heads 72.

Although the detailed composition of the maintenance control unit 179 is not shown, the maintenance control unit 179 controls the movement timing and the movement speed of the head 72 in the processing region of the cleaning processing section 160, in accordance with control signals from the system controller 172, as well as controlling the drive speed of the cleaning liquid pump 165 (flow speed of the cleaning liquid), the driving of conveyance of a web in the wiping unit 274, the elevator mechanism of the web, and the like.

More specifically, the maintenance control unit 179 controls the maintenance processing unit 199 in such a manner that maintenance of the head 72 (the cleaning process of the nozzle surface 72A) is carried out in the following sequence. Firstly, the head 72 is moved to the processing region of the maintenance processing unit 199. Thereupon, the cleaning liquid application unit 162 is moved in the vertical direction and the distance between the cleaning liquid holding surface 162A (see FIG. 7) and the nozzle surface 72A is thereby adjusted.

When the head 72 and the cleaning liquid application unit 162 have been registered in position, the cleaning liquid is supplied to the cleaning liquid holding surface 162A from the cleaning liquid supply port 163. The amount of cleaning liquid supplied per unit time from the cleaning liquid supply port 163 to the cleaning liquid holding surface 162A can be adjusted by controlling the driving speed and duration of the pump 165.

When the cleaning liquid layer 161 between the nozzle surface 72A and the cleaning liquid holding surface 162A has wet the surfaces and spread completely, the head 72 is moved in the lengthwise direction thereof while maintaining the distance between the nozzle surface 72A and the cleaning liquid holding surface 162A, and the cleaning liquid is thereby applied to the whole of the nozzle surface 72A. During this movement of the head 72, the cleaning liquid is replenished from the cleaning liquid supply port 163 by driving the pump 165 appropriately, so that the cleaning liquid layer 161 never ceases to be present between the nozzle surface 72A and the cleaning liquid holding surface 162A.

When a prescribed time period has elapsed after the application of the cleaning liquid to the whole of the nozzle surface 72A, the head 72 is moved to the processing region of the wiping unit 274, and the cleaning liquid on the nozzle surface 72A is wiped away by the wiping unit 274. Then, the head 72 is moved to the processing region of the nozzle cap 276 and preliminary ejection is performed from the head 72. After completing the maintenance processing of the head 72, the head 72 is moved to the prescribed image formation position.

According to the cleaning processing unit 160 having the composition described above, when the cleaning liquid is supplied from the cleaning liquid supply port 163 arranged in the upper portion 162B of the inclined cleaning liquid holding surface 162A, between the nozzle surface 72A and the cleaning liquid holding surface 162A, which is arranged with the inclination substantially in parallel with the nozzle surface 72A, then the cleaning liquid wets the surfaces and spreads between the nozzle surface 72A and the cleaning liquid holding surface 162A and also travels from the upper portion to the lower portion of the inclination. Therefore, it is possible to apply the cleaning liquid to the nozzle surface 72A in a non-contact fashion, and the amount of cleaning liquid consumed can be greatly reduced.

Furthermore, it is possible to reuse the cleaning liquid after use, by arranging the recovery tray 166, which recovers the used cleaning liquid, and the filter 168, which carries out a recycling process for the used cleaning liquid, in the lower portion 162C of the inclined cleaning liquid holding surface 162A.

Modified Embodiments

Next, a modification of the aforementioned embodiment will be described.

Figure 10:
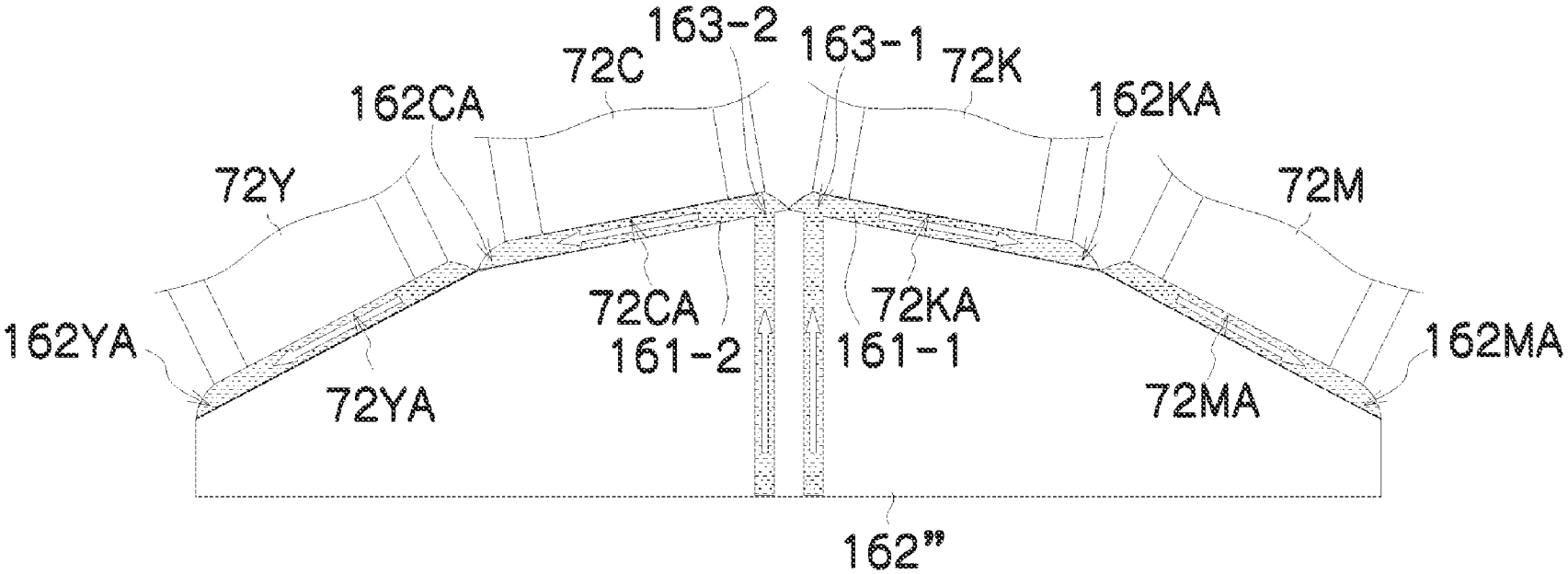
FIG. 10 is a general schematic drawing of a cleaning liquid application unit according to a modified embodiment of the present invention.
Figure 11:
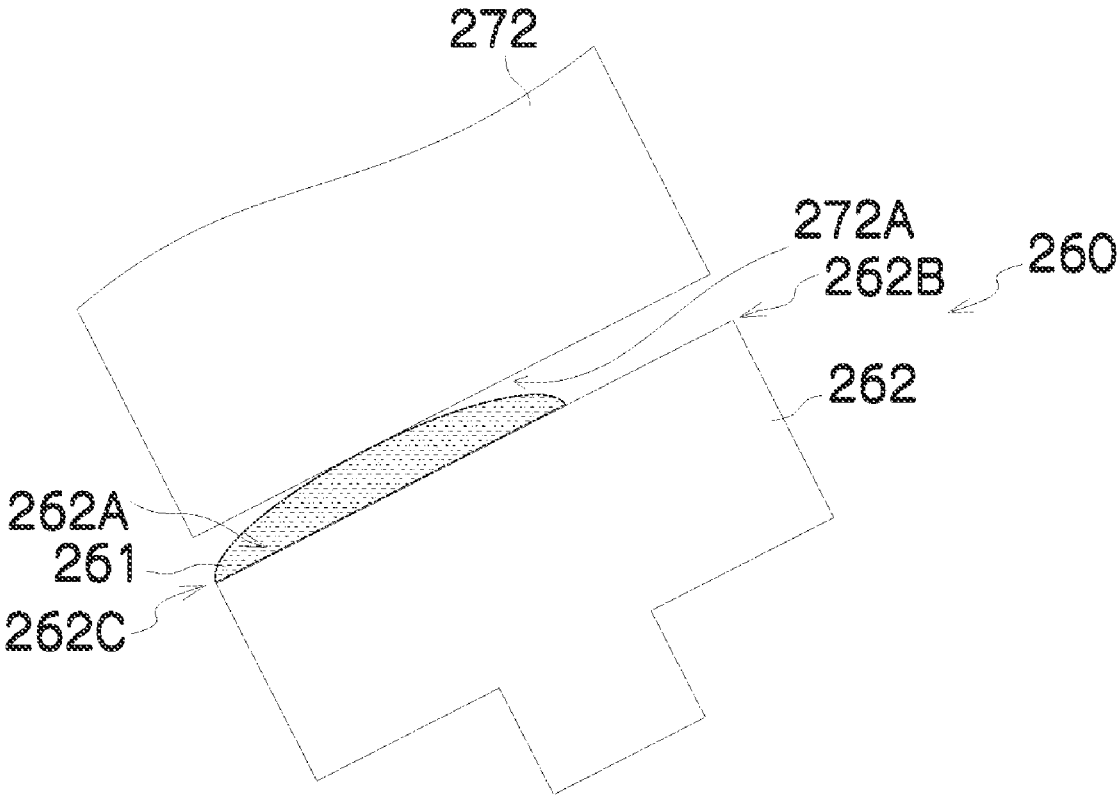
FIG.11 RELATED ART
FIG. 11 is a diagram for describing the related art.

FIG. 10 is a structural diagram showing a cleaning liquid application unit 162" according to the present modified embodiment, and shows a view in the breadthways direction of the heads 72M, 72K, 72C and 72Y (and the direction perpendicular to the sheet of the drawing corresponds to the lengthwise direction of the heads 72M, 72K, 72C and 72Y).

The cleaning liquid application unit 162" shown in FIG. 10 has cleaning liquid holding surfaces 162MA, 162KA, 162CA and 162YA each having an inclination corresponding respectively to the heads 72M, 72K, 72C and 72Y (see also FIG. 1).

More specifically, the cleaning liquid application unit 162" has: the cleaning liquid holding surface 162MA, which is inclined substantially in parallel with the nozzle surface 72MA of the head 72M; the cleaning liquid holding surface 162KA, which is inclined substantially in parallel with the nozzle surface 72KA of the head 72K; the cleaning liquid holding surface 162CA, which is inclined substantially in parallel with the nozzle surface 72CA of the head 72C; and the cleaning liquid holding surface 162YA, which is inclined substantially in parallel with the nozzle surface 72YA of the head 72Y.

The cleaning liquid holding surfaces 162MA, 162KA, 162CA and 162YA are formed continuously. The upper portion of the inclined cleaning liquid holding surface 162MA and the lower portion of the inclined cleaning liquid holding surface 162KA are mutually connected, the upper portion of the inclined cleaning liquid holding surface 162KA and the upper portion of the inclined cleaning liquid holding surface 162CA are mutually connected, and the lower portion of the inclined cleaning liquid holding surface 162CA and the upper portion of the inclined cleaning liquid holding surface 162YA are mutually connected.

The cleaning liquid application unit 162" shown in FIG. 10 has two cleaning liquid supply ports 163-1 and 163-2. The first cleaning liquid supply port 163-1 is arranged in the upper portion of the inclined cleaning liquid holding surface 162KA, and the second cleaning liquid supply port 163-2 is arranged in the upper portion of the inclined cleaning liquid holding surface 162CA.

The cleaning liquid 161-1 that has been supplied from the first cleaning liquid supply port 163-1 to the cleaning liquid holding surface 162KA passes between the nozzle surface 72KA and the cleaning liquid holding surface 162KA, and then flows between the nozzle surface 72MA and the cleaning liquid holding surface 162MA. Similarly, the cleaning liquid 161-2 that has been supplied from the second cleaning liquid supply port 163-2 to the cleaning liquid holding surface 162CA passes between the nozzle surface 72CA and the cleaning liquid holding surface 162CA, and then flows between the nozzle surface 72YA and the cleaning liquid holding surface 162YA. In FIG. 10, outlined arrows indicate the directions of movement of the cleaning liquid.

When the heads 72M, 72K, 72C and 72Y are moved at a prescribed speed in the lengthwise direction of the heads 72M, 72K, 72C and 72Y, in a state where the cleaning liquid is in contact with the nozzle surfaces 72YA, 72KA, 72CA and 72YA of the heads 72M, 72K, 72C and 72Y, then the cleaning liquid is applied in a single operation over the whole of the nozzle surfaces 72YA, 72KA, 72CA and 72YA of the heads 72M, 72K, 72C and 72Y.

Although not shown in FIG. 10, the cleaning liquid tank 164, the pump 165 for recovering the used cleaning liquid, the recovery tray 166, the pump 167 for supplying the cleaning liquid, and the like, shown in FIG. 7 are provided as appropriate.

Furthermore, it is desirable that the wiping unit 274 and the nozzle cap 276 adopt compositions which enable the heads 72M, 72K, 72C and 72Y to be processed together in a single operation.

In the above-described modified embodiment, it is possible to carry out the cleaning processing, in the inkjet recording apparatus having the plurality of heads 72, with respect to the heads 72 together in a single operation, and the time required for the maintenance processing can be shortened significantly.

In the present embodiments, the mode has been described in which the maintenance processing unit 199 is appended to the inkjet recording apparatus 10; however, it is also possible to compose a maintenance apparatus for the inkjet head by separating the maintenance processing unit 199 from the inkjet recording apparatus 10.

Moreover, it may also be composed as a processing apparatus which has the respective functions of the cleaning processing unit 160, the wiping unit 274 and the nozzle cap 276, which compose the maintenance processing unit 199.

Furthermore, in the present embodiments, the inkjet recording apparatus has been described which records a color image by ejecting and depositing color inks onto a recording medium as one example of an image forming apparatus; however, the present invention can also be applied to an image forming apparatus which forms a prescribed pattern shape on a substrate by means of a resin liquid, or the like, in order, for instance, to form a mask pattern or to print wiring of a printed wiring board.

Appendix

As has become evident from the detailed description of the embodiments given above, the present specification includes disclosure of various technical ideas below.

It is preferable that an inkjet head cleaning apparatus, comprising: a cleaning liquid holding device having a cleaning liquid holding surface with which cleaning liquid is held and applied to a liquid ejection surface of an inkjet head in which the liquid ejection surface is oblique to a horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

According to this mode, since the cleaning liquid is deposited onto the liquid ejection surface by supplying the cleaning liquid from the upper portion of the inclined cleaning liquid holding surface, which is disposed in the position facing the liquid ejection surface of the inkjet head oblique to the horizontal plane and which is inclined substantially in parallel with the liquid ejection surface with respect to the horizontal plane, whereby the cleaning liquid slides down the inclined cleaning liquid holding surface while wetting the liquid ejection surface and the cleaning liquid holding surface and spreading between the surfaces, then it is possible to apply the cleaning liquid over the whole of the liquid ejection surface of the inkjet head by using a small quantity of cleaning liquid compared to a method in which the cleaning liquid is sprayed from an entire surface facing the liquid ejection surface of the inkjet head, and therefore the amount of cleaning liquid supplied between the liquid ejection surface and the cleaning liquid holding surface can be greatly reduced.

The inkjet head is a liquid ejection head which ejects liquid from nozzles (apertures) arranged in the liquid ejection surface, using an inkjet method, and one embodiment of the composition of such a head includes liquid chambers connected to the nozzles and pressure applying devices which apply pressure to the liquid inside the liquid chambers. Furthermore, the liquid to be ejected from the inkjet head includes various liquids, such as color inks which form (record) an image on a recording medium, or a resin liquid which forms a prescribed pattern on a substrate, or the like.

The "upper portion of the inclined cleaning liquid holding surface" can be any portion of the inclined cleaning liquid holding surface upper from the portion facing the nozzle surface of the inkjet head where the nozzles are formed. One mode of the cleaning liquid supply port for supplying the cleaning liquid from the upper portion of the inclination is one where the cleaning liquid supply port is arranged in the upper end portion of the inclined cleaning liquid holding surface.

Preferably, the cleaning liquid supply port is arranged in the cleaning liquid holding surface.

According to this mode, it is possible to compose the cleaning liquid holding device and the cleaning liquid supply device as a single body, thus contributing to space saving. Preferably, the cleaning liquid holding device has a plurality of cleaning liquid holding surfaces corresponding to a plurality of inkjet heads.

According to this mode, it is also possible to shorten the cleaning processing time for the apparatus having the plurality of inkjet heads, since a cleaning process can be carried out simultaneously with respect to the inkjet heads.

Preferably, a dimension of the cleaning liquid holding surface in a direction of the inclination is not smaller than a dimension of the inkjet head in the direction of the inclination.

According to this mode, it is possible to deposit the cleaning liquid uniformly onto the whole of the inkjet head in the direction of the inclination.

Preferably, the cleaning liquid supply device supplies the cleaning liquid at a flow speed of not lower than 80 mm/sec and not higher than 150 mm/sec.

According to this mode, the cleaning liquid is able to move while wetting the liquid ejection surface of the inkjet head and the cleaning liquid holding surface while spreading between the surfaces.

Preferably, a contact angle of the cleaning liquid with respect to the cleaning liquid holding surface is not smaller than 80 degrees.

According to this mode, a coating layer of the cleaning liquid is formed on the cleaning liquid holding surface and the cleaning liquid moves while wetting the liquid ejection surface of the inkjet head and the cleaning liquid holding surface while spreading between the surfaces.

Preferably, the distance between the cleaning liquid holding surface and the liquid ejection surface is not smaller than 1 mm and not larger than 2 mm. More desirably, the distance between the cleaning liquid holding surface and the liquid ejection surface is approximately 1.5 mm.

It is also preferable that an image recording apparatus comprises: an inkjet head which has a liquid ejection surface oblique to a horizontal plane; and an inkjet head cleaning unit which applies cleaning liquid to the liquid ejection surface of the inkjet head, wherein the head cleaning unit includes: a cleaning liquid holding device having a cleaning liquid holding surface with which cleaning liquid is held and applied to a liquid ejection surface of an inkjet head in which the liquid ejection surface is oblique to a horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

In this mode, a desirable mode is one where a head movement device which moves the inkjet head to the processing region of the inkjet head cleaning unit is provided, and the inkjet head is moved to the processing region of the inkjet head cleaning unit when carrying out a cleaning process of the liquid ejection surface of the inkjet head.

A desirable mode is one where the cleaning liquid is applied over the whole of the liquid ejection surface by moving the inkjet head in the processing region of the inkjet head cleaning unit.

Preferably, the apparatus further comprises: a recording medium conveyance device which includes a recording medium holding roller having a recording medium holding region in which a recording medium is held on an outer circumferential surface of the recording medium holding roller, and conveys the recording medium in a prescribed direction by rotating the recording medium holding roller on a rotational axis thereof; and a plurality of inkjet heads which correspond respectively to a plurality of liquids, each of the inkjet heads having the liquid ejection surface oblique to the horizontal plane at a position following the outer circumferential surface of the recording medium holding roller and facing the outer circumferential surface, wherein the cleaning liquid holding device has a plurality of cleaning liquid holding surfaces arranged with mutually different inclinations corresponding respectively to the inkjet heads.

According to this mode, it is possible to apply the cleaning liquid in a single operation to the liquid ejection surfaces having mutually different inclinations, with respect to the inkjet heads having the liquid ejection surfaces oblique to the horizontal plane.

Preferably, the cleaning liquid holding surfaces are arranged continuously to each other.

According to this mode, by arranging the cleaning liquid holding surfaces continuously to each other, it is possible to use a common supply system for the cleaning liquid and a common recovery system for the used cleaning liquid, and increase in the size of the head cleaning unit can be avoided.

Preferably, the inkjet head is a line type inkjet head in which a plurality of nozzles are arranged through a length corresponding to a maximum width of the recording medium; a dimension of the cleaning liquid holding surface in a direction of the inclination is not smaller than a breadth of the line type inkjet head; and the apparatus further comprises a relative movement device which moves the line type inkjet head and the cleaning liquid holding device at a prescribed movement speed relatively to each other in a lengthwise direction of the line type inkjet head.

According to this mode, it is possible to apply the cleaning liquid to the whole of the liquid ejection surface of a line type head, in a single process.

It is also preferable that a method of cleaning an inkjet head having a liquid ejection surface oblique to a horizontal plane, the method comprises the steps of: applying cleaning liquid to the liquid ejection surface through a cleaning liquid holding surface, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and supplying the cleaning liquid from an upper portion of the inclined cleaning liquid holding surface in such a manner that the cleaning liquid slides down the inclined cleaning liquid holding surface while forming a meniscus between the cleaning liquid holding surface and the liquid ejection surface.

A desirable mode is one further comprising the step of moving the inkjet head to the cleaning processing region, and the step of applying the cleaning liquid to the whole of the liquid ejection surface by moving the inkjet head in the cleaning processing region.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head cleaning apparatus, comprising:

a cleaning liquid holding device having a cleaning liquid holding surface with which cleaning liquid is held and applied to a liquid ejection surface of an inkjet head in which the liquid ejection surface is oblique to a horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

2. The apparatus as defined in claim 1, wherein the cleaning liquid supply port is arranged in the cleaning liquid holding surface.

3. The apparatus as defined in claim 1, wherein the cleaning liquid holding device has a plurality of cleaning liquid holding surfaces corresponding to a plurality of inkjet heads.

4. The apparatus as defined in claim 1, wherein a dimension of the cleaning liquid holding surface in a direction of the inclination is not smaller than a dimension of the inkjet head in the direction of the inclination.

5. The apparatus as defined in claim 1, wherein the cleaning liquid supply device supplies the cleaning liquid at a flow speed of not lower than 80 mm/sec and not higher than 150 mm/sec.

6. The apparatus as defined in claim 1, wherein a contact angle of the cleaning liquid with respect to the cleaning liquid holding surface is not smaller than 80 degrees.

7. The apparatus as defined in claim 1, wherein the distance between the cleaning liquid holding surface and the liquid ejection surface is not smaller than 1 mm and not larger than 2 mm.

8. An image recording apparatus, comprising:

an inkjet head which has a liquid ejection surface oblique to a horizontal plane; and an inkjet head cleaning unit which applies cleaning liquid to the liquid ejection surface of the inkjet head, wherein the head cleaning unit includes:

a cleaning liquid holding device having a cleaning liquid holding surface with which cleaning liquid is held and applied to the liquid ejection surface of the inkjet head in which the liquid ejection surface is oblique to the horizontal plane, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and a cleaning liquid supply device which has a cleaning liquid supply port through which the cleaning liquid is supplied from an upper portion of the inclined cleaning liquid holding surface in such a manner that the cleaning liquid slides down the inclined cleaning liquid holding surface while forming a meniscus between the cleaning liquid holding surface and the liquid ejection surface.

9. The apparatus as defined in claim 8, further comprising:

a recording medium conveyance device which includes a recording medium holding roller having a recording medium holding region in which a recording medium is held on an outer circumferential surface of the recording medium holding roller, and conveys the recording medium in a prescribed direction by rotating the recording medium holding roller on a rotational axis thereof; and a plurality of inkjet heads which correspond respectively to a plurality of liquids, each of the inkjet heads having the liquid ejection surface oblique to the horizontal plane at a position following the outer circumferential surface of the recording medium holding roller and facing the outer circumferential surface, wherein the cleaning liquid holding device has a plurality of cleaning liquid holding surfaces arranged with mutually different inclinations corresponding respectively to the inkjet heads.

10. The apparatus as defined in claim 8, wherein:

the inkjet head is a line type inkjet head in which a plurality of nozzles are arranged through a length corresponding to a maximum width of the recording medium;

a dimension of the cleaning liquid holding surface in a direction of the inclination is not smaller than a breadth of the line type inkjet head; and the apparatus further comprises a relative movement device which moves the line type inkjet head and the cleaning liquid holding device at a prescribed movement speed relatively to each other in a lengthwise direction of the line type inkjet head.

11. The apparatus as defined in claim 9, wherein the cleaning liquid holding surfaces are arranged continuously to each other.

12. A method of cleaning an inkjet head having a liquid ejection surface oblique to a horizontal plane, the method comprising the steps of:

applying cleaning liquid to the liquid ejection surface through a cleaning liquid holding surface, the cleaning liquid holding surface being arranged with an inclination such that the cleaning liquid holding surface is substantially parallel with the liquid ejection surface of the inkjet head and faces the liquid ejection surface at a prescribed distance from the liquid ejection surface; and supplying the cleaning liquid from an upper portion of the inclined cleaning liquid holding surface in such a manner that the cleaning liquid slides down the inclined cleaning liquid holding surface while forming a meniscus between the cleaning liquid holding surface and the liquid ejection surface.

* * * * *